US011011326B2

(12) United States Patent
Xu

(10) Patent No.: US 11,011,326 B2
(45) Date of Patent: May 18, 2021

(54) BUTTON

(71) Applicant: Goertek Technology Co., Ltd., Qingdao (CN)

(72) Inventor: Peng Xu, Qingdao (CN)

(73) Assignee: GOERTEK TECHNOLOGY CO. LTD., Shandong (CN)

( * ) Notice: Subject to any disclaimer, the term of this patent is extended or adjusted under 35 U.S.C. 154(b) by 0 days.

(21) Appl. No.: 16/961,041

(22) PCT Filed: Jan. 9, 2018

(86) PCT No.: PCT/CN2018/071955
§ 371 (c)(1),
(2) Date: Jul. 9, 2020

(87) PCT Pub. No.: WO2019/136602
PCT Pub. Date: Jul. 18, 2019

(65) Prior Publication Data

US 2021/0057174 A1 Feb. 25, 2021

(51) Int. Cl.

| | |
|---|---|
| ***H01H 13/04*** | (2006.01) |
| ***G05G 1/02*** | (2006.01) |
| ***G05G 5/05*** | (2006.01) |
| ***H01H 13/14*** | (2006.01) |
| *H01H 13/52* | (2006.01) |

(52) U.S. Cl.
CPC ..... *H01H 13/04* (2013.01); *G05G 1/02* (2013.01); *G05G 5/05* (2013.01); *H01H 13/14* (2013.01);
(Continued)

(58) Field of Classification Search
CPC ..... G05G 1/02; G05G 1/025; G05G 1/04; G05G 1/06; G05G 1/10; G05G 1/12;
(Continued)

(56) References Cited

U.S. PATENT DOCUMENTS

| | | | | |
|---|---|---|---|---|
| 4,813,111 | A * | 3/1989 | Nohren | B64D 17/32 24/573.11 |
| 2006/0260102 | A1* | 11/2006 | Miyake | A44C 3/001 24/90.1 |
| 2011/0067365 | A1* | 3/2011 | Stephens | A63B 69/0068 54/44.1 |
| 2011/0253518 | A1* | 10/2011 | Wang | H01H 13/14 200/341 |

(Continued)

FOREIGN PATENT DOCUMENTS

| | | | |
|---|---|---|---|
| CN | 102332363 | A | 1/2012 |
| CN | 103187195 | A | 7/2013 |
| CN | 203746719 | U | 7/2014 |
| CN | 206134560 | U | 4/2017 |
| CN | 206697398 | U | 12/2017 |
| JP | 2008282773 | A | 11/2008 |

OTHER PUBLICATIONS

International Search Report and Written Opinion dated Aug. 1, 2018 in International Application No. PCT/CN2018/071955.

*Primary Examiner* — Richard W Ridley
*Assistant Examiner* — Brian J McGovern
(74) *Attorney, Agent, or Firm* — Baker Botts L.L.P.

(57) ABSTRACT

A button is disclosed. The button includes: a lower button shell, which is a hollow structure with an upper opening, and is provided with a first sliding pin hole through a side wall of the lower button shell; an upper button shell, which is a hollow structure with a lower opening, wherein a side wall of the upper button shell is provided with a second sliding pin hole, the upper button shell is sleeved on the lower button shell, and the second sliding pin hole is directly opposite to the first sliding pin hole; a moveable tray, which is located at a central position in the lower button shell; a sliding arm, one end of which is rotatably connected to the moveable tray; a sliding pin, which is located in the lower button shell.

10 Claims, 3 Drawing Sheets

(52) U.S. Cl.
CPC ..... *G05G 2505/00* (2013.01); *H01H 13/52* (2013.01)

(58) Field of Classification Search
CPC ..... G05G 5/05; G05G 9/047; G05G 2009/04703; G05G 2009/0474; G05G 2009/04748; G05G 2009/04755; H01H 25/04; H01H 3/02; H01H 3/04; H01H 3/12; H01H 3/122; H01H 3/46; H01H 2003/127; H01H 13/14
See application file for complete search history.

(56) References Cited

U.S. PATENT DOCUMENTS

| | | | | |
|---|---|---|---|---|
| 2012/0312673 | A1* | 12/2012 | Young | H01H 13/60 200/52 R |
| 2015/0340178 | A1* | 11/2015 | Shimoyama | H01H 13/14 200/4 |
| 2017/0001106 | A1* | 1/2017 | Gassoway | A63F 13/22 |
| 2018/0033572 | A1* | 2/2018 | Ockert | H01H 13/14 |
| 2020/0387187 | A1* | 12/2020 | Liang | A63H 30/04 |

* cited by examiner

BUTTON

CROSS-REFERENCE TO RELATED APPLICATIONS

This application is a National Stage of International Application No. PCT/CN2018/071955, filed on Jan. 9, 2018.

TECHNICAL FIELD

This application belongs to the technical field of electronic equipments, and more specifically to a button.

BACKGROUND

In the prior art, as a commonly used control switch device in an electronic equipment, the buttons are prone to wear, damage, paint drop and other undesirable conditions, which degrades the user's use and experience. For a traditional button, the button is connected to a main body of the electronic device or the main body of the controller via a slot structure. However, this structure is not easy to disassemble. When a button is damaged and needs to be replaced, tools need to be used and a suitable force point needs to be found to disassemble the button, requiring users to have stronger manual abilities.

In the game entertainment industry, the gamepad already has an irreplaceable position for the game controller, and buttons are an important part of controllers, due to frequent use, after damage, the traditional way to replace buttons is to disassemble the whole machine, and then replace the buttons again, which further increases the workload, and the disassembly and assembly of the whole machine is easy to cause the controller to be in a bad state, which ultimately affects the user's experience. In addition, when users are pursuing individuation, there is also a need to replace buttons, and further requirements are placed on the material and touch of the button contact surface. The traditional upgrade method is to upgrade the entire machine, resulting in a huge waste of resources.

Therefore, it is necessary to provide an improved button structure so that it is easy to disassemble and save time and effort.

SUMMARY

An object of the present application is to provide a new technical solution for buttons.

According to a first aspect of the present application, a button is provided, which includes:

a lower button shell, which is a hollow structure with an upper opening, and is provided with a first sliding pin hole through a side wall of the lower button shell;

an upper button shell, which is a hollow structure with a lower opening, wherein a side wall of the upper button shell is provided with a second sliding pin hole, the upper button shell is sleeved on the lower button shell, and the second sliding pin hole is directly opposite to the first sliding pin hole.

a moveable tray, which is located at a central position within the lower button shell;

a sliding arm, one end of which being rotatably connected to the moveable tray;

a sliding pin, which is located in the lower button shell, wherein one end of the sliding pin is rotatably connected with the other end of the sliding arm which is apart from the moveable tray, wherein the other end of the sliding pin extends through the first sliding pin hole into the second sliding pin hole and prevents a up-and-down movement of the upper button shell relative to the lower button shell from being separated from the lower button shell;

wherein, when the moveable tray is being moved upward or downward relative to the lower button shell, the moveable tray is configured to use the sliding arm to drive the sliding pin to move horizontally into the lower button shell and separate the sliding pin from the second sliding pin hole.

Optionally, the sliding arm comprises an upper sliding arm, a lower sliding arm and a reset member. One end of the sliding arm is the upper sliding arm, and the other end is the lower sliding arm. The upper sliding arm is slidably sleeved with the lower sliding arm, the two ends of the reset member are respectively connected to one end of the upper sliding arm and one end of the lower sliding arm that are opposite to each other, the reset member is configured to provide a reset driving force that brings the upper sliding arm and the lower sliding arm closer to each other when they move apart from each other.

Optionally, one end of the upper sliding arm that is non-rotatably connected and/or the lower sliding arm that is non-rotatably connected is a hollow cylindrical structure with an opening at an end surface, and is sleeved with an opposite end of the sliding arm.

Optionally, the reset member is a first elastic member, which is disposed inside the hollow cylindrical structure, with its two ends respectively connected with the upper sliding arm and the lower sliding arm.

Optionally, a magnet is further included, and the magnet is disposed on the moveable tray and fixedly connected with the moveable tray.

Optionally, a second elastic member is further included, and the second elastic member is located between the moveable tray and the upper button shell, and both ends of the second elastic member are pressed against the moveable tray and the upper button shell respectively.

Optionally, the cross section of the second sliding pin hole in the opening direction is smaller than the cross section of the first sliding pin hole in the opening direction.

Optionally, the upper button shell is provided with a position limiter protruding toward the lower button shell, the position limiter is opposite to the moveable tray and limits a maximum distance the moveable tray moves upward relative to the lower button shell.

Optionally, a lower part of the lower button shell has a supporting platform, and the supporting platform is located below the first sliding pin hole and extends outward of the lower button shell, and the side wall of the upper button shell is sleeved on the supporting platform.

Optionally, a plurality of sliding pins are included, and the first sliding pin hole, the second sliding pin hole and the sliding arm in one-to-one correspondence with the sliding pin.

One technical effect of this application is that the buttons provided in this application are easy to disassemble.

Through the following detailed description of the exemplary embodiments of the present application with reference to the accompanying drawings, other features and advantages of the present application will become clear.

BRIEF DESCRIPTION OF THE DRAWINGS

The drawings incorporated in and forming a part of the specification illustrate embodiments of the present application, and together with the description thereof are used to explain the principles of the present application.

Figure 1:
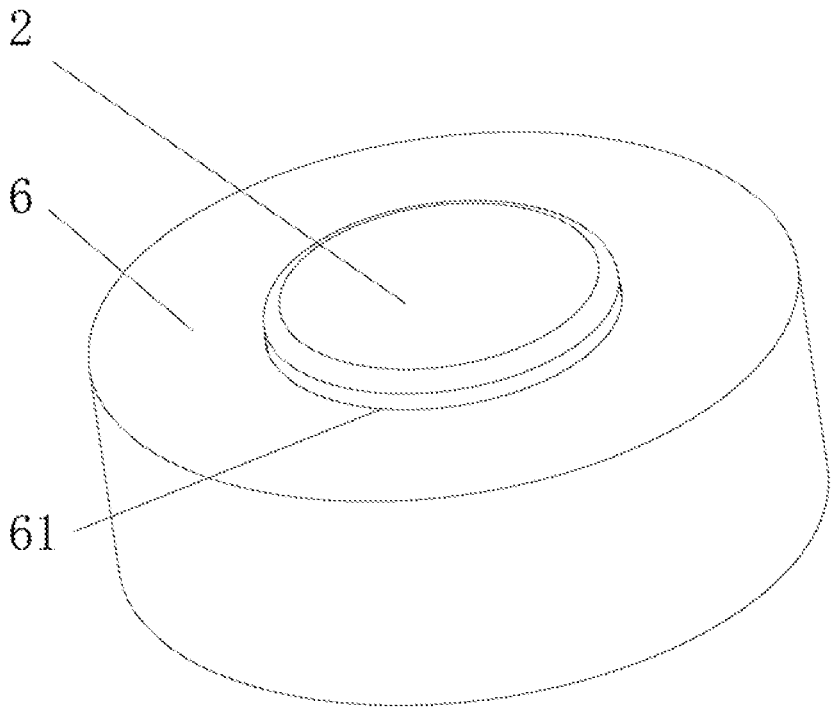
FIG. 1 is a schematic diagram of an external structure of a specific embodiment of the present application.

In the drawings: 1 lower button shell, 11 side wall of the lower button shell, 12 first sliding pin hole, 13 supporting platform, 14 protrusion, 2 upper button shell, 21 side wall of the upper button shell, 22 second sliding pin hole, 23 position limiter, 24 second elastic member, 3 moveable tray, 31 magnet, 4 sliding arm, 41 upper sliding arm, 42 lower sliding arm, 43 reset member. 5 sliding pin. 6 device shell, 61 button slot, 62 button slot inner wall, 7 circuit board, 71 circuit switch, 72 third elastic member.

DETAILED DESCRIPTION

Various exemplary embodiments of the present application will be described in detail with reference to the drawings. It should be noted that the relative arrangement, numerical expressions, and numerical values of the components and steps set forth in these embodiments do not limit the scope of the present application unless specifically stated otherwise.

The following description of at least one exemplary embodiment is actually merely illustrative, and in no way serves as any limitation to the present application and its application or use.

Techniques, methods and equipment known to those of ordinary skill in the related art may not be discussed in detail, but where appropriate, the techniques, methods and equipment should be considered as part of the specification.

In all examples shown and discussed herein, any specific values should be interpreted as merely exemplary and not limiting. Therefore, other examples of the exemplary embodiment may have different values.

It should be noted that similar reference numerals and letters indicate similar items in the following drawings, therefore, once an item is defined in one drawing, there is no need to discuss it further in subsequent drawings.

The present application provides a button with a structure easy to disassemble. In addition, for the upper button shell that is frequently pressed and easily damaged, it is easy and quick to disassemble and assemble, which is beneficial to the replacement and maintenance of the upper button shell. The overall structure of the button has no screws, and no special tools are needed for replacement and maintenance. The overall structure is simple and has fewer parts, which can simplify the production and assembly process and reduce production costs.

A button shown in FIGS. 1-4 includes a lower button shell 1, an upper button shell 2, a moveable tray 3, a sliding arm 4 and a sliding pin 5.

Figure 3:
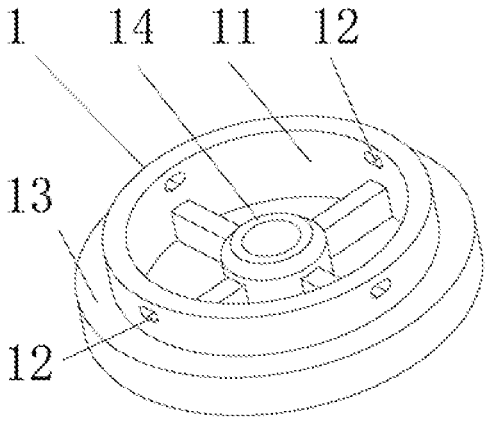
FIG. 3 is a schematic structural diagram of a lower button shell in a specific embodiment of the present application.

The lower button shell 1 is a hollow structure with an upper opening, and the hollow portion can be used to accommodate part or all of the components of the button. The hollow structure may be a stepped hollow cylindrical structure as shown in FIG. 3, in other embodiments, it may also be a hollow cuboid, a regular polygonal body or some special-shaped structures, which is not limited in this application. A first sliding pin hole 12 is provided on the side wall 11 of the lower button shell enclosing the hollow structure, and the first sliding pin hole 12 penetrates the side wall 11 of the lower button shell, so that the hollow portion of the lower button shell 1 can be connected to the outside through the first sliding pin hole 12.

The upper button shell 2 is a hollow structure with a lower opening. As described above, the specific shape of the upper button shell 2 is not limited in this application. A second sliding pin hole 22 is provided on the side wall of the upper button shell 21 enclosing the hollow portion of the upper button shell 2, and the second sliding pin hole 22 may or may not penetrate the side wall of the upper button shell 21, which is not limited in this application.

The upper button shell 2 is sleeved on the lower button shell 1, that is, the upper button shell 2 is sleeved on the side wall 11 of the lower button shell of the lower button shell 1 through the lower opening. The second sliding pin hole 22 is directly opposite to the first sliding pin hole 12 so that the second sliding pin hole 22 can be connected to the inside of the lower button shell 1 through the first sliding pin hole 12.

Those skilled in the art can understand that the shape and size of the upper button shell 2 and the lower opening thereof can correspond to that of the lower button shell 1 as shown in FIG. 3, and the inner diameter of the lower opening is equal to the outer diameter of the side wall 11 of the lower button shell of the lower button shell 1, which is beneficial to cooperative use, thus making its structure compact; but in different embodiments, it is not necessary to correspond, for example, assuming that the lower button shell 1 shown in FIG. 1 remains unchanged and is still the stepped hollow cylindrical structure, then when the upper button shell is a cuboid structure, the lower opening of the upper button shell is a square, and the side length of the square is larger than the diameter of the lower button shell 1, the upper button shell can also be sleeved on the lower button shell 1, or can also realize this application. The different shapes of the upper button shell 2 are convenient for personalized customization. Therefore, the present application does not require the coincidence between the shapes of the lower button shell 1 and the upper button shell 2.

The moveable tray 3 is located in the central position within the lower button shell 1. The moveable tray 3 can move upwards and downwards relative to the button, moving upwards is moving in the direction of the upper button shell 2 and moving downwards is moving in the direction of the lower button shell 1.

One end of the sliding arm 4 is rotatably connected to the moveable tray 3. The rotation connection may be the cooperation of the rotation shaft and the rotation hole. The rotation shaft and the rotation hole are respectively provided on the two connected components, and the rotation shaft is inserted into the rotation hole to form a rotation connection relationship. The sliding arm 4 can rotate relative to the moveable tray 3. One end of the sliding arm 4 can be rotatably connected to the edge of the moveable tray 3 to reduce the volume of the moveable tray 3 and reduce the weight of the buttons; and it is also easy to install and connect.

The sliding pin 5 is located in the lower button shell 1. One end of the sliding pin 5 is rotatably connected to the other end of the sliding arm 4 apart from the moveable tray 3. The other end of the sliding pin 5 extends through the first sliding pin hole 12 into the second sliding pin hole 22, which prevents the upper button shell 2 from moving upwards and downwards relative to the lower button shell 1 and they cannot be completely separated from each other. For example, when the inner diameter of the hole of the second sliding pin hole 22, the inner diameter of the hole of the first sliding pin hole 12 and the outer diameter of the sliding pin 5 are all the same, the moving upwards and downwards of the upper button shell 2 relative to the lower button shell 1 can be completely locked due to the hinder of the sliding pin 5; the movement in horizontal direction of the upper button shell 2 relative to the lower button shell 1 can be achieved by the inner diameter of the lower opening of the upper button shell 2 being equal to the outer diameter of the side wall of the upper button shell 11 of the lower button shell 1 or by structurally limiting the upper button shell 2 and the lower button shell 1 in the button application scenario, so that the lower button shell 1 and the upper button shell 2 form a whole, and when the upper button shell 2 is pressed, the lower button shell 1 is also pressed accordingly.

Figure 2:
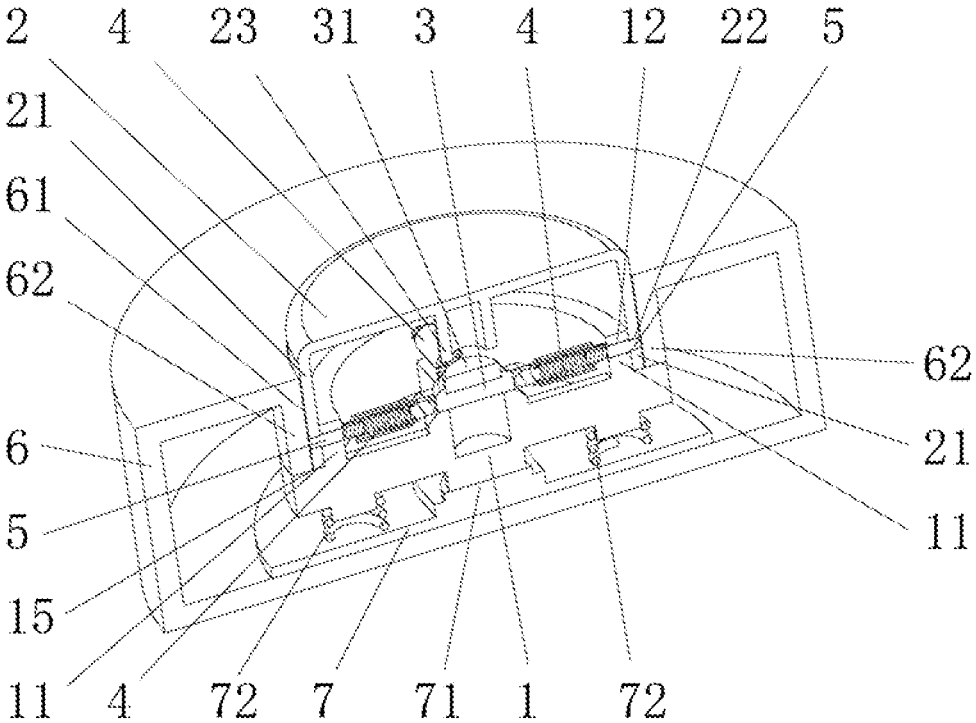
FIG. 2 is a schematic diagram of a cross-sectional structure of a specific embodiment of the present application.

When the moveable tray 3 moves upward or downward relative to the lower button shell 1, because both ends of the sliding arm 4 are rotatably connected to the moveable tray 3 and the sliding pin 5, for example in the embodiment shown in FIG. 2, the rotatably connected sliding arm 4 can rotate clockwise or counterclockwise relative to the moveable tray 3 and the sliding pin 5. And therefore, as the moveable tray 3 moves upward or downward, the included angle between the sliding arm 4 and the horizontal direction becomes larger and larger. Since the moveable tray 3 moves upward or downward only relative to the lower button shell 1 and the length of the sliding arm 4 is constant, then according to the Pythagorean Theorem, the sliding arm 4 will inevitably apply an acting force to the sliding pin 5 to moveable tray 3 along the sliding arm. This acting force is decomposed into vertical and horizontal acting forces, the moving upward and downward of the sliding pin 5 is hindered by the first sliding pin 12, the acting force in an upward and downward direction is hindered and canceled, and the acting force in an horizontal direction can drive the sliding pin 5 to slide along the first sliding pin 12 toward the inside of the lower button shell 1. The first sliding pin hole 12 provides a channel for the extension and retraction of the sliding pin 5, on the other hand, it also has a limiting and guiding function, guiding it to slide along the opening direction of the first sliding pin hole 12 without deviation. When the sliding pin 5 is retracted from the first sliding pin hole 12 and is separated from the second sliding pin hole 22, the upper button shell 2 and the lower button shell 1 can be separated for replacement and maintenance and other operations, which is simple and quick. With the same principle, the reverse transformation of the above process can realize the assembly of the upper button shell 2 and the lower button shell 1. It can be seen that the overall structure of the button of the present application has no screws, and no special tools such as a screwdriver are needed to replace and repair the upper button shell.

In different embodiments, the moveable tray 3 moves upward or downward relative to the lower button shell 1, the moveable tray 3 can be made of a magnetic material, and the south pole or north pole of the magnetic field faces the direction of the upper button shell 2 and is directly opposite to the upper button shell 4, the attraction or repulsion by a magnet on the top of the upper button shell 2 can drive the moveable tray 3 to move upward or downward; the moveable tray 3 can also be made of metal material that can be attracted by the magnet, the attraction by a magnet on the top of the upper button shell 2 can drive the moveable tray 3 to move upward, and after removing the magnet, the moving downward can be achieved under the influence of gravity or other structures etc.

Figure 4:
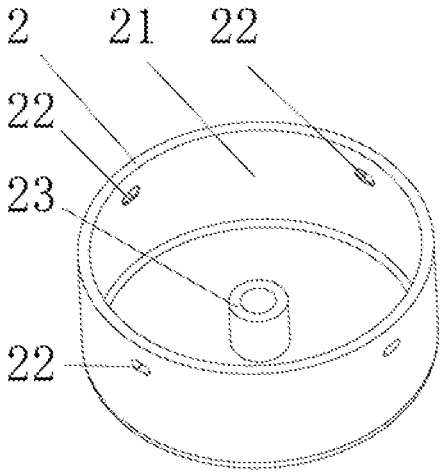
FIG. 4 is a schematic structural diagram of an upper button shell in a specific embodiment of the present application.
Figure 5:
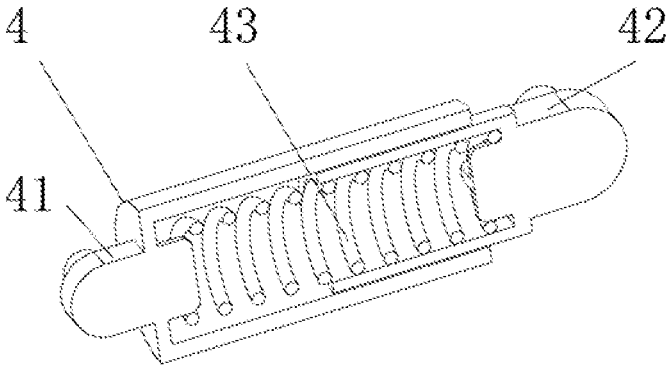
FIG. 5 is a schematic structural diagram of a sliding arm in a specific embodiment of the present application.

Optionally, as shown in FIGS. 2 and 4, the sliding arm 4 includes an upper sliding arm 41, a lower sliding arm 42 and a reset member 43. One end of the sliding arm 4 is the upper sliding arm 41, and the other end is the lower sliding arm 42. The upper sliding arm 41 and the lower sliding arm 42 are slidably sleeved. When the moveable tray 3 moves upward or downward, the sliding arm 4 can maintain sufficient rigidity and cannot be bent or deformed, resulting in the failure to provide the sliding pin 5 with the acting force or the change of the acting force direction. Both ends of the reset member 43 are connected to one ends of the upper sliding arm 41 and the lower sliding arm 42 respectively. One ends of the tipper sliding arm 41 and the lower sliding arm 42 connected to the reset member 43 is called a reset end, and the opposite end is a connecting end. The positional relationship between the upper sliding arm 41 and the lower sliding arm 42 can be set to a preset value. When the upper sliding arm 41 and the lower sliding arm 42 are apart from each other with respect to a preset value, the reset member 43 is used to provide a reset driving force to make their reset ends closer to each other. In some specific embodiments, it may further include that when the upper sliding arm 41 and the lower sliding arm 42 are closer to each other with respect to a preset value, the reset member 43 can provide a reset driving force to make their reset ends apart from each other. Those skilled in the art may understand that when the preset value is the minimum distance between the upper sliding arm 41 and the lower sliding arm 42, the reset member 43 can be disposed to provide stets a driving force to make them closer to each other. Through the setting of the resetting member 43, the movable tray 3 and the sliding pin 5 can be effectively provided with buffer protection to avoid damage to the rotating connection structure, when the movable tray 3 moves upward or downward.

Optionally, as shown in FIGS. 2 and 4, the non-rotatably connected end of the upper sliding arm 41 and/or the lower sliding arm 42, that is, the reset end, is a hollow cylindrical structure with an opening at the end surface and can be sleeved on the opposite end of the sliding arm 4, forming a sliding sleeve, so that the upper sliding arm 41 and the lower sliding arm 42 can both slide relatively and guide and restrict the sliding direction. For example, when the reset end of the upper sliding arm 41 is a hollow cylindrical structure, and the reset end of the lower sliding arm 42 is a cylindrical or hollow cylindrical, the inner diameter of the reset end of the upper sliding arm 41 is equal to the outer diameter of the reset end of the lower sliding arm 42 to form a sliding sleeve. In other embodiments, the reset end may also be a hollow cuboid or other structure, which is not limited in this application.

Optionally, as shown in FIGS. 2 and 4, the reset member 43 is a first elastic member. The elastic member may be an elastic structure or material such as a spring or a silica gel column, which can deform under the action of an external force, and can restore its original size and shape when the external force is removed. The reset member 43 is provided in the above-mentioned hollow cylindrical structure, and the two ends are respectively connected to the upper sliding arm 41 and the lower sliding arm 42. When the upper sliding arm 41 and the lower sliding arm 42 slide relative to each other, an opposite driving force can be provided to drive them to reset. It can be understood that, when the upper sliding arm 41 and the lower sliding arm 42 are in the preset positions, the sliding pin 5 locks the upper button shell 2 and the lower button shell 1, and the reset member 43 is in a state free of external force, that is, neither compressed nor stretched.

Optionally, as shown in HG. 2, the button further includes a magnet 31, which is disposed on the moveable tray 3 and fixedly connected to the moveable tray 3, and the south pole or north pole of the magnetic field of the magnet 31 faces the direction of the upper button shell 2, the magnet 31 can be directly opposite to the upper button shell 4. At this time, the moveable tray 3 can be made of lightweight materials such as plastics, which can reduce the weight of the buttons on the one hand and the production cost of the buttons on the other hand. The magnet 31 and the moveable tray 3 can be fixed by bonding or embedding etc. The magnet 31 and the moveable tray 3 are fixed into an integral structure. The magnet 31 can drive the moveable tray 3 to move together when attracted or repelled.

Optionally, as shown in FIG. 2, when the moveable tray 3, the sliding arm 4 and the sliding pin 5 are in a normal state where they lock the upper button shell 2 and the lower button shell 1, all of them are in a horizontal position with respect to each other, and the sliding direction of the sliding pin 5 is perpendicular to the moving direction of the moveable tray 3. Set the sliding distance of the sliding pin 5 to the inside of the back of the lower button shell 1 as D1, set the moving distance upward or downward of the moveable tray 3 as D2, and set the angle between the sliding arm driven by the movement of the moveable tray 3 and the horizontal plane as θ, and then in an ideal state, $D1=D2/\tan\theta$.

Optionally, during installation, the moveable tray 3 may be placed on the lower surface of the central position in the lower button shell 1, or as shown in FIG. 3, a protrusion 14 may be provided for placing the moveable tray 3. At this time, the moveable tray 3 can only drive the sliding pin 5 to slide out of the second sliding pin hole 22 by moving upward. And the installation is simple and the production cost can be reduced. Reinforcing ribs and other structures may be provided between the protrusion 14 and the side wall 11 of the lower button shell to strengthen the overall strength of the lower button shell 1.

Figure 6:
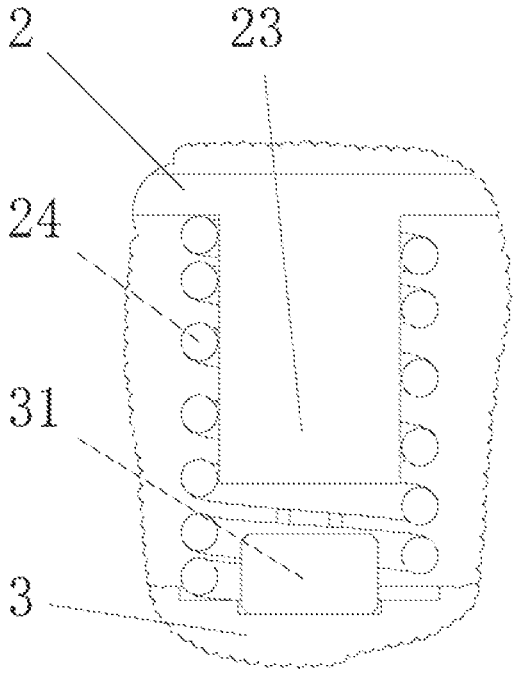
FIG. 6 is a schematic diagram of a connection relationship of a second elastic member in a specific embodiment of the present application.

Optionally, as shown in FIG. 6, the button may further include a second elastic member 24. The second elastic member 24 is located between the moveable tray 3 and the upper button shell 2. The two ends of the second elastic member 24 are pressed against the moveable tray and the upper button shell respectively, thereby applying a downward force to the moveable tray 3 or no elastic force is applied to the moveable tray. This prevents the moveable tray 3 from moving upward relative to the lower button shell 1 due to sliding during the use of the button, and accidentally removing locking between the lower button shell 1 and the upper button shell 2 and causing the accident loss of the upper button shell 2, which affects the stability of the buttons. In the disassembly process, the upward acting force applied on the moveable tray 3 by the magnetic force is greater than the elastic force of the second elastic member 24, so that the upper button shell 2 can be disassembled.

Alternatively, as shown in FIG. 2, the cross section in the opening direction of the second sliding pin hole 22 is smaller than the cross section in the opening direction of the first sliding pin hole 12. The cross sections of the sliding pin 5 also have this correspondence respectively, and the cross section of the opening direction of the portion of the sliding pin 5 protruding into the second sliding pin hole 22 is also smaller than the cross section of the opening direction of the portion of the sliding pin 5 located in the first sliding pin hole 12, and a wedge-shaped limit is formed on the sliding pin 5 to limit the distance it protrudes outward from the first sliding pin hole 12. In different embodiments, in the opening direction, the cross section of the second sliding pin hole 22 may be equal to the cross section of the first sliding pin hole 12; this application is not limited to this, as long as the technical solution of this application can be realized. Those skilled in the art can understand that the cross sections of the second sliding pin hole 22 and the first sliding pin hole 12 in the opening direction do not necessarily have to be circular, but can also be rectangular, elliptical, or polygonal structures. The shape of the hole is not limited in this application, as long as it is beneficial for the sliding pin 5 to slide in the first sliding pin hole 12.

Optionally, as shown in FIG. 2, the upper button shell 2 is provided with a position limiter 23 protruding toward the lower button shell 1, the position limiter 23 is opposite to the moveable tray 3, and the maximum distance that the moveable tray 3 moves upward relative to the lower button shell 1 is limited, which prevents the moveable tray 3 from moving upward too large distance, and the sliding pin 5 from sliding out of the first sliding pin hole 12 and increasing the difficulty of installation. On the other hand, the second elastic member 24 can be sleeved on the position limiter 23, because the second elastic member 24 is not fixedly connected to the moveable tray 3 and the upper button shell 2 respectively, the position limiter 23 can play a guiding role for the compression and deformation of the second elastic member 24, preventing the second elastic member 24 from being deformed in a horizontal direction when subjected to pressure, and then deviating from the preset position and reducing the stability of the button.

Optionally, as shown in FIGS. 2 and 3, the lower part of the lower button shell 1 has a supporting platform 13, the supporting platform 13 is located below the first sliding pin hole 12 and protrudes horizontally to the outside of the lower button shell 1, the side wall of the upper button shell 21 of the upper button shell 2 is sleeved on the supporting platform 13, and supports the upper button shell 2 during installation, which can also make the first sliding pin hole 12 and the second sliding pin hole 22 are on the same plane, which is convenient for installation.

Optionally, as shown in FIG. 2, a plurality of sliding pins 5 is included in the button. The other first sliding pin hole 12, second sliding pin hole 22 and sliding arm 4 correspond to the sliding pin 5 one by one, and can lock the lower button shell 1 and the upper button shell 2 from multiple directions. In some specific embodiments, the plurality of sliding pins 5 are symmetrically arranged in the lower button shell 1 relative to the lower button shell 1, which is beautiful and easy to assemble.

Optionally, as shown in FIG. 2, under the condition that the structural strength and function can be satisfied, some structural parts, such as the position limiter 23 and the protrusion 14 may be provided with cut holes to form a hollow structure to reduce the weight of the button, improve the hand feeling, and also reduce production costs.

For the button as shown in FIGS. 1-6, it includes the following steps when disassembling the upper button shell 2:

Place an external magnet on the upper surface of the upper button shell 2 and make it opposite to the magnet 31, attracting the magnet 31 to move upward;

The magnet 31 drives the moveable tray 3 to move upward;

The moveable tray 3 moves upward, driving the lower sliding arm 42 rotatably connected to the moveable tray to slide relative to the upper sliding arm 41, apart from the upper sliding arm 41, stretching the reset member 43, and the sliding arm 4 inclines;

The reset member 23 provides a pulling force to drive the upper sliding arm 41 to move in the direction of the lower sliding arm 42;

The lower sliding arm 42 drives the sliding pin to slide along the first sliding pin hole 12 toward the inside of the lower button shell 1;

The sliding pin 5 is separated from the second sliding pin hole 22;

Turn the upper button shell 2 so that the second sliding pin hole 22 and the first sliding pin hole 12 are not directly opposite;

Remove the external magnet and pull out the upper button shell 2 to complete the disassembly of the upper button shell 2.

When installing the upper button shell 2, the following steps are included:

Push the upper button shell 2 down into the sleeve;

When obstructed by the sliding pin 5, an external magnet is used to attract the magnet 31 and move it upward;

After the sliding pin 5 is retracted, continue to insert the upper button shell 2 until the supporting platform 13;

When the external magnet is removed, the moveable tray 3 is driven downward by the second elastic member 24. When the second sliding pin hole 22 is directly opposite to the first sliding pin hole 12, the sliding pin 5 slides into the second sliding pin hole 22 to complete the installation; when the second sliding pin hole 22 is not directly opposite to the first sliding pin hole 12, the upper button shell 2 is rotated so that the second sliding pin hole 22 is directly opposite to the first sliding pin hole 12, and the sliding pin 5 slides into the second sliding pin hole 22 to complete the installation.

According to another aspect of the present application, there is also provided an electronic device, as shown in a specific embodiment shown in FIGS. 1-2, it includes a device shell body 6 and the above-mentioned button. The button is arranged in the device shell body 6, the upper button shell 2 is apart from the upper surface of the lower button shell 1 and is located outside the device shell body 6, which is convenient for the user to press the upper button shell 2 during use. The upper surface may be made of silicone layer material to enhance user experience.

Optionally, as shown in FIGS. 1-2, a button slot 61 is disposed in the device shell body 6, and the button is disposed in the button slot 61 and can slide up and down relative to the device shell body 6. Optionally, the button slot 61 has an button slot inner wall 62 extending downwards, the button slot inner wall 62 is sleeved on the lower button shell 1, and the maximum distance that the lower button shell 1 moves upward is limited to prevent the lower button shell 1 from sliding out of the device shell body 6, for example, the button slot inner wall 62 is sleeved on the supporting platform 13. The inner diameter of the button slot inner wall 62 is larger thin the outer diameter of the upper button shell 2, so that the upper button shell 2 can be smoothly taken out of the button slot 61 during disassembly and installation. It can be understood that the device shell body 6 may include several interlocking shell bodies, and the lower button shell 2 can be installed in the button slot 61 by interlocking with each other.

Optionally, as shown in FIGS. 1-2, a circuit board 7 may be further included. The circuit board 7 is provided with a circuit switch 71. The circuit switch 71 is opposite to the lower button shell 1. By pressing the button, the circuit switch 71 is triggered, an electrical signal is sent out, and control is performed. Further, a third elastic member 72 is provided between the circuit board 7 and the lower button shell 1, the third elastic member 72 drives the lower button shell 1 apart from the circuit board 7, and the third elastic member 72 may cooperate with the button slot inner wall 62 to fix the lower button shell 1 in the upward and downward direction. The lower button shell 1 may also be provided with a pressing portion facing the circuit switch 71, so as to increase the gap between the lower surface of the lower button shell 1 and the circuit board 7, and provide space and buffer for the installation of the third elastic member 72.

Although some specific embodiments of the present application have been described in detail through examples, those skilled in the art should understand that the above examples are only for illustration, not for limiting the scope of the present application. Those skilled in the art should understand that the above embodiments can be modified without departing from the scope and spirit of the present application. The scope of the application is defined by the appended claims.

The invention claimed is:

1. A button, comprising:

a lower button shell, having a hollow structure with an upper opening, provided with a first sliding pin hole through a side wall of the lower button shell;

an upper button shell, having a hollow structure with a lower opening, wherein a side wall of the upper button shell is provided with a second sliding pin hole, the upper button shell is sleeved on the lower button shell, and the second sliding pin hole is directly opposite to the first sliding pin hole;

a moveable tray, located at a central position in the lower button shell;

a sliding arm, having a first end rotatably connected to the moveable tray;

a sliding pin, located in the lower button shell, Wherein one end of the sliding pin is rotatably connected with a second end of the sliding arm which is apart from the moveable tray, wherein the second end of the sliding pin extends through the first sliding pin hole into the second sliding pin hole to prevent a up-and-down movement of the upper button shell relative to the lower button shell from being separated from the lower button shell;

wherein, the moveable tray is configured to use the sliding arm to drive the sliding pin to move horizontally into the lower button shell and separate the sliding pin from the second sliding pin hole upon being moved upward or downward relative to the lower button shell.

2. The button of claim 1, Wherein the sliding arm comprises an upper sliding arm, a lower sliding arm and a reset member, wherein one end of the sliding arm is an upper sliding arm and the other end is a lower sliding arm, wherein the upper sliding arm is slidably sleeved with the lower sliding arm, two ends of the reset member are respectively connected to one end of the upper sliding arm and one end of the lower sliding arm which are opposite to each other, the reset member is configured to provide a reset driving force that brings the upper sliding arm and the lower sliding arm closer to each other when they move apart from each other.

3. The button of claim 1, wherein one end of the upper sliding arm that is non-rotatably connected and/or the lower sliding arm that is non-rotatably connected is a hollow cylindrical structure with an opening at an end surface, and is sleeved with an opposite end of the sliding arm.

4. The button of claim 3, wherein the reset member is a first elastic member, which is disposed inside the hollow cylindrical structure, with its two ends respectively connected with the upper sliding arm and the lower sliding arm.

5. The button of claim 1, further comprises a magnet, wherein the magnet is disposed on the moveable tray and fixedly connected with the moveable tray.

6. The button of claim 1, further comprises a second elastic member which is located between the moveable tray and the upper button shell, and both ends of the second elastic member are pressed against the moveable tray and the upper button shell respectively.

7. The button of claim 1, wherein a cross section of the second sliding pin hole in the opening direction is smaller than the cross section of the first sliding pin hole in the opening direction.

8. The button of claim 1, wherein the upper button shell is provided with a position limiter protruding toward the lower button shell, wherein the position limiter is opposite to the moveable tray and limits a maximum distance the moveable tray moves upward relative to the lower button shell.

9. The button of claim 1, wherein a lower part of the lower button shell has a supporting platform, wherein the supporting platform is located below the first sliding pin hole and extends outward of the lower button shell, and the side wall of the upper button shell is sleeved on the supporting platform.

10. The button of claim 1, further comprises a plurality of Sliding pins, wherein the first sliding pin hole, the second sliding pin hole and the sliding arm are in one-to-one correspondence with the sliding pin.

* * * * *